US005492244A

United States Patent [19]

Kim

[11] Patent Number: 5,492,244

[45] Date of Patent: Feb. 20, 1996

[54] DIVIDED ALUMINUM CAN WITH INDEPENDENTLY ACCESSIBLE COMPARTMENTS

[76] Inventor: Stanley D. C. Kim, 311 Ohua Ave. #505E, Honolulu, Hi. 96815

[21] Appl. No.: 276,868

[22] Filed: Jul. 18, 1994

[51] Int. Cl.[6] ..... B65D 21/02

[52] U.S. Cl. ..... 220/524; 220/906; 220/23.8

[58] Field of Search ..... 220/906, 23.83, 220/23.8, 524, 553, 269, 271, 23.86

[56] References Cited

U.S. PATENT DOCUMENTS

| | | | |
|---|---|---|---|
| 3,326,406 | 6/1967 | Brown | 220/269 |
| 4,073,403 | 2/1978 | Orange | 220/269 |
| 4,919,295 | 4/1990 | Hitzler | 220/906 |
| 5,335,813 | 8/1994 | Qi | 220/906 |
| 5,397,014 | 3/1995 | Aydt | 220/271 |

FOREIGN PATENT DOCUMENTS

| | | | |
|---|---|---|---|
| 404072143 | 3/1992 | Japan | 220/906 |

*Primary Examiner*—Stephen J. Castellano
*Attorney, Agent, or Firm*—Eugene Oak

[57] ABSTRACT

The present invention is a standard, twelve-ounce aluminum can which may be divided into two or three equal size chambers. Partitions are installed within the can which separate the chambers in such a way that each one is air-tight. Each chamber may be opened independently, allowing a user to store unused contents while retaining freshness. A single tab, located on the top of the can, may be rotated to access each of the openings.

2 Claims, 3 Drawing Sheets

DIVIDED ALUMINUM CAN WITH INDEPENDENTLY ACCESSIBLE COMPARTMENTS

FIELD OF THE INVENTION

The present invention generally relates to an aluminum can for holding fluids such as soft drinks and beer, particularly to a can which is separated into two or three air-tight chambers.

BACKGROUND OF THE INVENTION

The aluminum can has been the favorite soft drink and beer container for decades. Soda machines exist at almost any place where one might decide to stop. The quick and easy method of popping the top of an aluminum can has become the standard answer to refreshment for today's busy lifestyle.

As ideal as the aluminum can may be, there is still room for improvement. The twelve ounces present in a standard aluminum can is often too much for a person to finish in one sitting. An aluminum can which has been opened, however, cannot be stored in a refrigerator because it will soon lose its carbonation (become flat). Thus, there are no real alternatives than to either unwillingly finish the contents or to throw the remainder away, neither of which are very desirable. When a person becomes thirsty again, he or she must open a new can because the unused portion of the previous can could not be stored. This results in an excessive amount of aluminum waste.

Six-ounce cans have been developed, but are very rare and far from being manufactured on a large scale. Smaller size cans are also available in other countries, particularly in Europe, but are not imported into the United States presently. Almost all of the soft drink and beer manufacturers existing today use equipment which has been designed to produce twelve-ounce cans. It is therefore both difficult and risky for a manufacturer to attempt to produce a different size can.

Thus, it is presently desired for a twelve ounce aluminum can which is able to effectively store unused contents.

SUMMARY OF THE INVENTION

The present invention solves the problems discussed above by providing an aluminum can which is divided into two separate airtight chambers of equal size by one vertically installed partition. Each chamber has a separate opening which provides access to that particular chamber. One rotatable tab, attached to the center of the top of the can, is able to open both of the openings. Furthermore, the presently invented can is able to hold two different fluids, such as Coke and Sprite, because the chambers are completely separated from each other. The present invention essentially provides two drink cans in one, resulting in less aluminum waste and a cleaner environment.

A second embodiment of the present invention functions in the same manner and method as described above, except that three chambers are provided instead of two.

Thus, it is a primary object of the present invention to provide an aluminum can which is able to hold approximately twelve ounces of fluid.

It is another object of the invention to provide a can with two separate, air-tight chambers of equal size.

It is another object of the invention to provide one partition vertically installed within said can.

It is another object of the invention to provide a separate opening for each of the chambers.

It is another object of the invention to provide a conventional rotatable tab located at the center of the top of said can.

It is another object of the invention to provide an alternative embodiment which contains three separate chambers rather than two.

It is another object of the invention to reduce aluminum waste in the environment.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
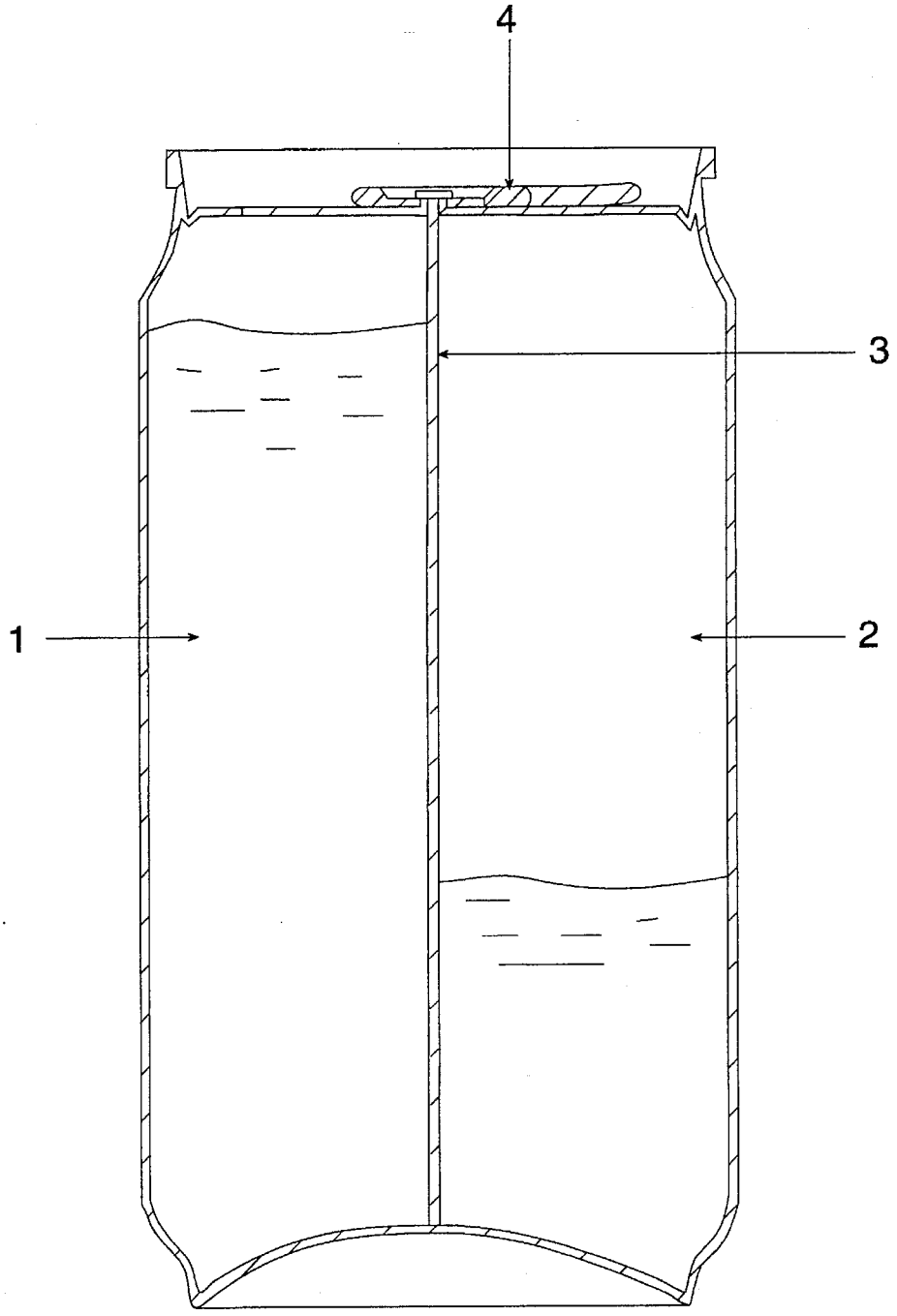
FIG. 1 is a sectional side view of one embodiment of the present invention.

Referring now to FIG. 1, a side view of one embodiment of the present invention is shown. A left chamber 1 is separated from a right chamber 2 by a centrally installed partition 3. The partition 3 seals the chambers 1 and 2 from each other in such a way that the air pressure in one chamber is not influenced by a change of air pressure in the other. Each of the chambers has a conventional opening which releases the pressure contained within when a tab presses down upon it. The right chamber 2 is approximately one-third full while the left chamber 3 is almost completely full. Once the contents of chamber 2 have been emptied, the can may be stored in a refrigerator. The unopened contents of chamber 1 will remain as fresh as a new can. When a person wishes to drink the contents of chamber 1, he or she will simply rotate the tab 4, as shown in FIG. 2.

Figure 2:
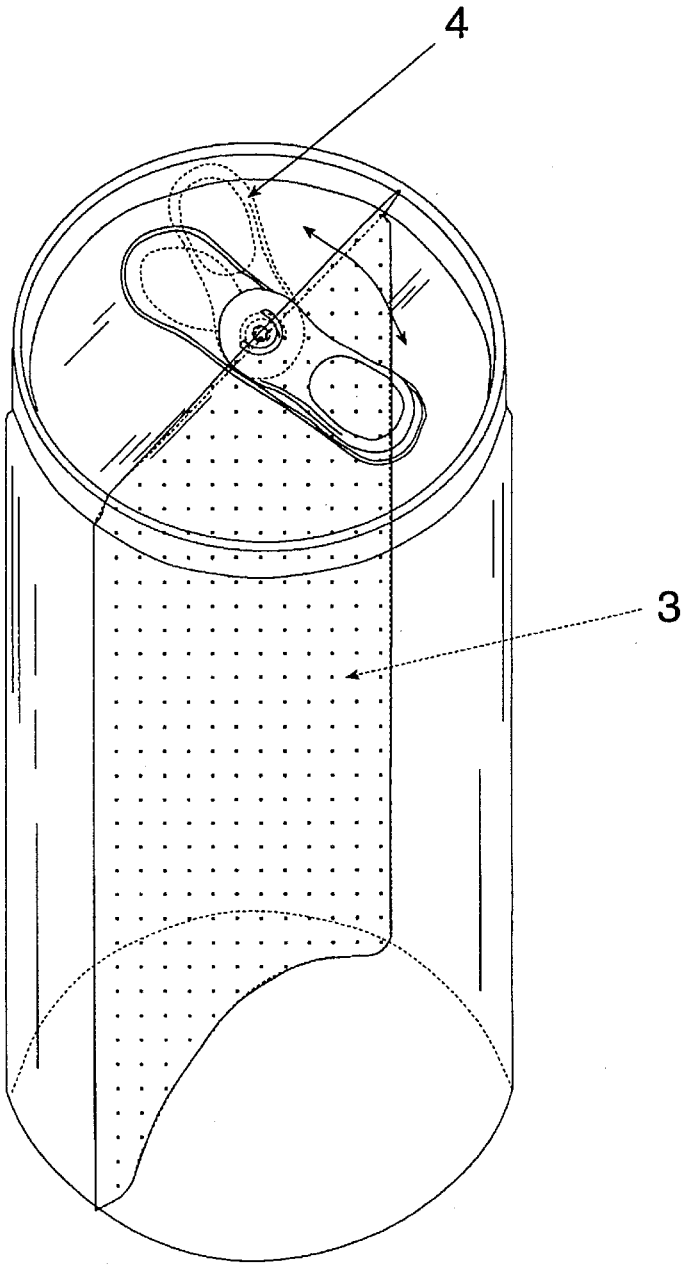
FIG. 2 is a view of the present invention showing the top of the present invention.

Referring now to FIG. 2, the top of the present invention is shown. A tab 4 is attached to the center of the top of the can. This tab 4 may be rotated 360 degrees, thus allowing it to open either of the chambers of the can.

Figure 3:
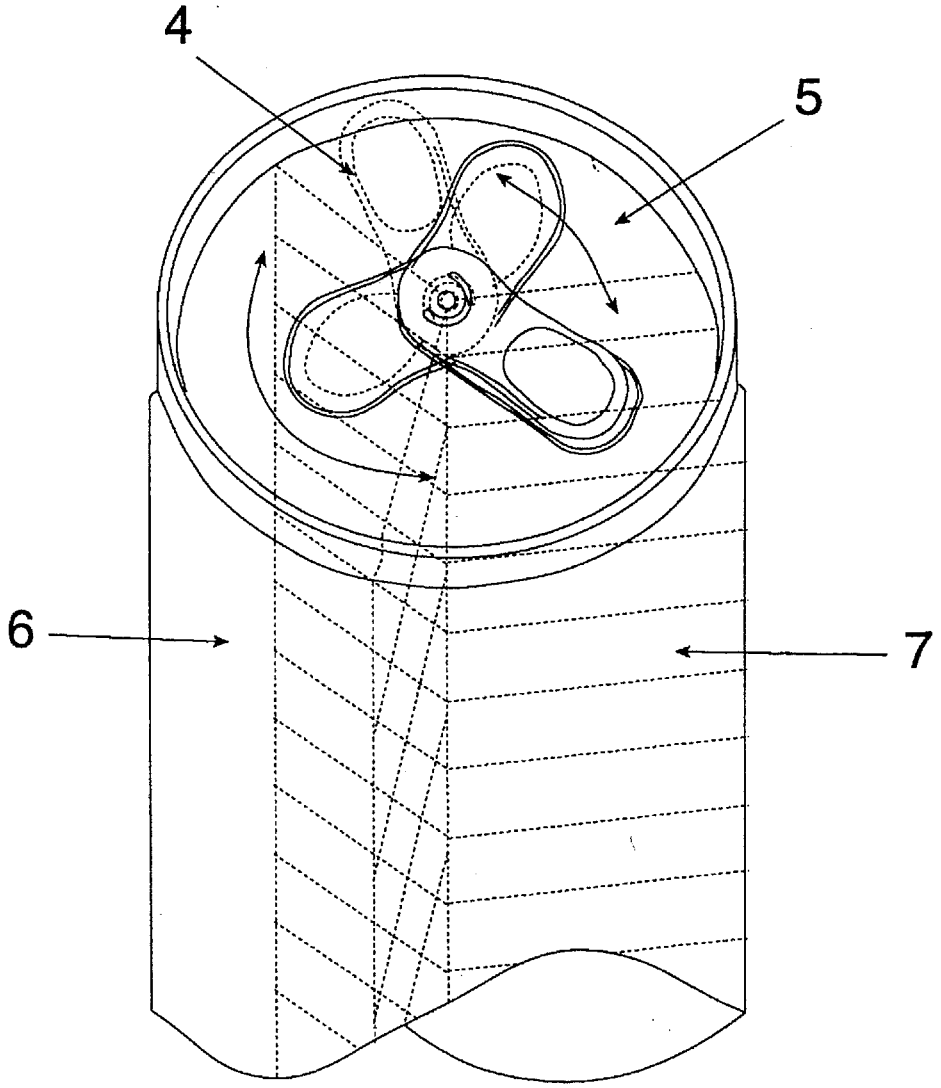
FIG. 3 is a sectional view of a second embodiment of the present invention.

Referring now to FIG. 3, another embodiment of the present invention is shown. This embodiment contains three chambers rather than two. These chambers are labeled 5, 6, and 7, and are separated by partitions in the same way as the first embodiment of the present invention. As in the first embodiment, each chamber has a conventional opening. The same tab 4 used in the first embodiment of the present invention may be used in this embodiment to open all three of the openings.

I claim:

1. An aluminum can comprising:

a cylindrical body having a circular, flat top attached thereabove;

a partition installed vertically within said body dividing said body into two separate chambers of equal size;

said partition dividing said chambers such that air pressure in one chamber is not affected by a change of air pressure in other chamber;

a pull tab rotatably attached to center of said circular, flat top;

a prescored portion in said circular, flat top, forming an opening in said one chamber when engaged, actuated and ruptured by said pull tab; and a second prescored portion in said circular, flat top, forming an opening in said other chamber when engaged, actuated and ruptured by said pull tab.

2. An aluminum can comprising:

a cylindrical body having a circular, flat top attached thereabove;

three partitions installed vertically within said body dividing said body into three separate chambers of equal size;

said partitions dividing said chambers such that air pressure in one chamber is not affected by a change of air pressure in either of other chambers;

a pull tab rotatably attached to center of said circular, flat top;

a prescored portion in said circular, flat top, forming an opening in said one chamber when engaged, actuated and ruptured by said pull tab;

a second prescored portion in said circular, flat top, forming an opening in one of said other chambers when engaged, actuated and ruptured by said pull tab; and a third prescored portion in said circular, flat top, forming an opening in other of said other chambers when engaged, actuated and ruptured by said pull tab.

* * * * *